United States Patent [19]

Kawakami et al.

[11] 4,039,418

[45] Aug. 2, 1977

[54] ELECTRODEPOSITED METAL PLATE PEELING OFF MACHINE

[75] Inventors: Kozi Kawakami, Gifu; Makoto Iseri, Takehara, both of Japan

[73] Assignee: Mitsui Mining & Smelting Co., Ltd., Tokyo, Japan

[21] Appl. No.: 670,386

[22] Filed: Mar. 25, 1976

[30] Foreign Application Priority Data

Mar. 31, 1975 Japan ..... 50-39580

[51] Int. Cl.[2] ..... C25D 1/04; C25D 1/20

[52] U.S. Cl. ..... 204/198; 204/225

[58] Field of Search ..... 204/12, 281, 194, 225, 204/198

[56] References Cited

U.S. PATENT DOCUMENTS

| | | | |
|---|---|---|---|
| 3,636,677 | 1/1972 | McNamara et al. | 204/12 |
| 3,847,779 | 11/1974 | Sekine et al. | 204/281 |
| 3,953,312 | 4/1976 | Kikkawa et al. | 204/12 |

*Primary Examiner*—T. M. Tufariello

*Attorney, Agent, or Firm*—Blanchard, Flynn, Thiel, Boutell & Tanis

[57] ABSTRACT

The electrodeposited metal plate peeling off machine comprises a hammering apparatus, a peeling off apparatus, and a transfer means installed throughout the foregoing apparatuses for the purpose of intermittently transferring a cathode plate between different working stations. A discharging apparatus is disposed in the rear of the peeling off apparatus and devised to receive a cathode plate sent out from the peeling off apparatus without having its electrodeposited metal plate peeled off successfully by the peeling off apparatus. The discharge apparatus is activated by a means for sensing success or failure of the peeling-off of the metal plate when the operation of the peeling off apparatus is over. An apparatus for supplying spare cathode plates is disposed parallel to the discharging apparatus, whereby every time a cathode plate with unpeeled metal plate sensed by said sensing means arrives at said discharging apparatus, said cathode plate with unpeeled metal plate is discharged to the outside of the machine and a spare base plate is supplied by said supplying apparatus to fill the resulting vacancy.

7 Claims, 12 Drawing Figures

(A)

(A)

(C)

ELECTRODEPOSITED METAL PLATE PEELING OFF MACHINE

BACKGROUND OF THE INVENTION

1. Field of the Invention

The present invention relates to an electrodeposited metal plate peeling off machine, which functions to sense any contingent failure of peeling-off of the electrodeposited metal plate attached to both sides of a cathode plate and discharge the sensed cathode plate with unpeeled metal plate and also functions to fill a vacancy arising from said discharge with a spare base plate separated from the electrodeposited metal plate.

2. Description of the Prior Art

Nowadays, the electrodeposited metal plate peeling off process in the nonferrous metal refinery has been mechanized and the electrodeposited metal plate can be automatically peeled off a cathode plate. However, the condition of cohesion of the electrodeposited metal plate to the base plate is not uniform: it varies with, for instance, the composition of electrolyte, the temperature of electrolyte, the current density, the condition of the surface of base plate, etc., and there often comes out the so-called base plate with unpeeled metal plate or base plate with tightly stuck metal plate. Therefore, according to the prior art, the working personnel usually keep an eye on the peeling off apparatus, and whenever a cathode plate that failed to have its electrodeposited metal plate peeled off the base plate by means of the peeling off apparatus (hereinafter called 'base plate with unpeeled metal plate') comes out, the working personnel would take the trouble of stopping the peeling off apparatus and removing said base plate with unpeeled metal plate. Accordingly, the operation has hitherto been very troublesome.

SUMMARY OF THE INVENTION

In view of the foregoing defects in the prior art, one object of the present invention is to provide an electrodeposited metal plate peeling off machine which will overcome varieties of defects as above.

Another object of the present invention is to provide an electrodeposited metal plate peeling off machine, which comprises a hammering apparatus, a peeling off apparatus and a transfer means, with the addition of an apparatus for discharging base plates with unpeeled metal plate to the outside of the machine and further a sensing means attached to the peeling off apparatus for the purpose of sensing success or failure of peeling-off work when the operation of said peeling off apparatus is over, whereby any base plate with unpeeled metal plate — or cathode plate of which the peeling-off of metal plate has not been sensed by said sensing means — is remembered, and whenever a base plate with unpeeled metal plate arrives at said discharging apparatus by means of said transfer means, the discharging apparatus is actuated under instructions from the sensing means to discharge said base plate with unpeeled metal plate to the outside of the transfer means, thereby rendering it possible to automatically perform the removal of base plate with unpeeled metal plate which has hitherto been carried out manually, entailing enhancement of the operation efficiency and economy in personnel expenses.

A further object of the present invention is to provide an electrodeposited metal plate peeling off machine, which comprises an apparatus for supplying spare base plates in addition to the discharging apparatus for base plate with unpeeled metal plate as disposed parallel to said discharging apparatus, whereby a vacancy in the transfer means corresponding to the capacity occupied by the base plate with unpeeled metal plate discharged by the discharging apparatus is filled up with a spare base plate thereby rendering it possible to perform the succeeding process of returning the base plate to an electrolytic cell smoothly and accurately.

DETAILED DESCRIPTION OF THE INVENTION

Figure 1:
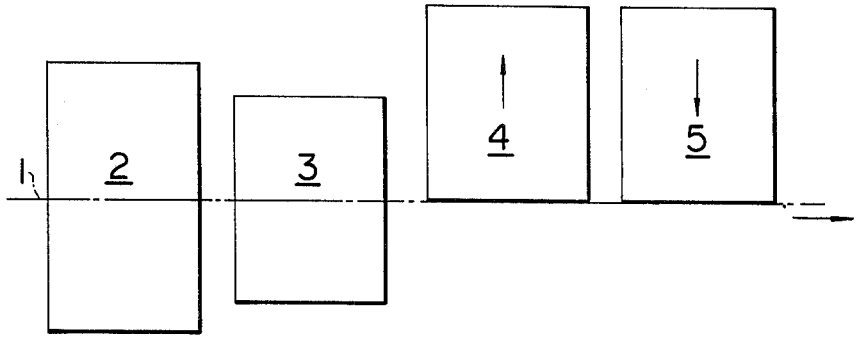
FIG. 1 is a block diagram illustrative of one embodiment of the present invention.

Details of the present invention will be explained hereunder with reference to an embodiment shown in the appended drawings. In the drawings, the reference numeral 1 denotes a crossfeed conveyer for cathode plate P, and along this crossfeed conveyer 1 are installed at specified intervals the hammering apparatus 2, the electrodeposited metal plate peeling off apparatus 3, the discharging apparatus 4 for discharging base plate with unpeeled metal plate P to the outside of the system and the supplying apparatus 5 for supplying spare base plates having their electrodeposited metal plates peeled off from the outside of the system after discharging the base plate with unpeeled metal plate, in order.

As to said hammering apparatus 2, though particulars thereof are not illustrated in the drawings, it is so devised as to apply impact on both sides of a cathode plate P conveyed sideways while having its lower end put on the crossfeed conveyer 1 and it upper end guided by guide plates thereby to form a fine gap between the cathode's base plate P and the electrodeposited metal plates P' adhering thereto.

Figure 2:
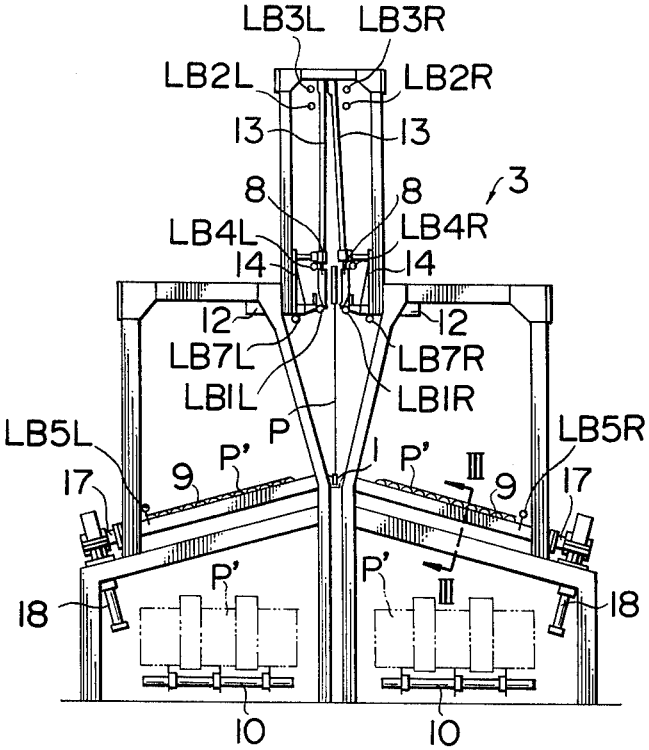
FIG. 2 is a front view of an electrodeposited metal plate peeling off apparatus according to the present invention.
Figure 3:
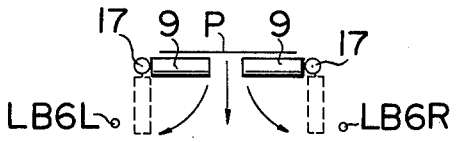
FIG. 3 is a cross-sectional view of the essential part of the apparatus in FIG. 2 as taken along the line III—III.
Figure 4:
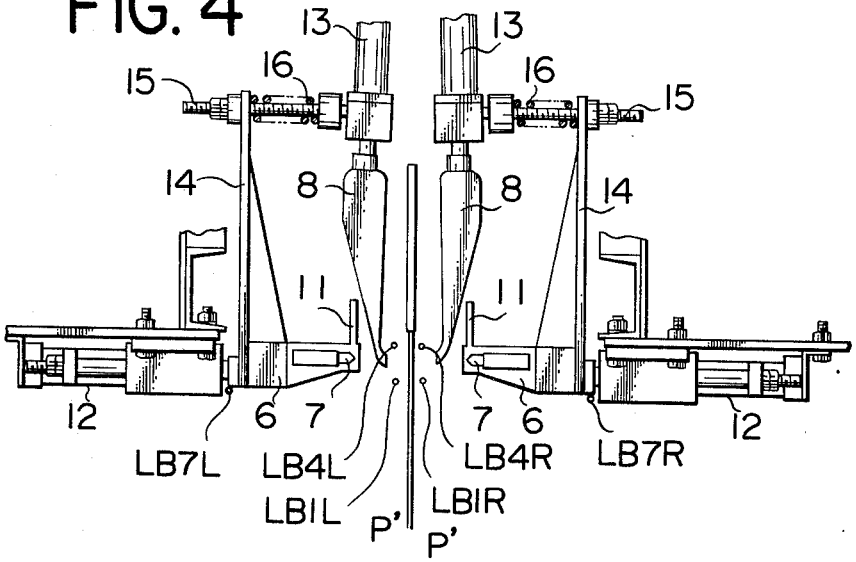
FIG. 4 is a front view — on an enlarged scale — of the essential part of the apparatus in FIG. 2.

The peeling off apparatus 3 for the electrodeposited metal plate P' is as illustrated in FIGS. 2–4. That is, it is equipped with the clamps 6 which are disposed along two sides of the cathode plate P to front on the region of movement of the upper part thereof and supposed to hold said cathode plate P between, the air nozzle pipes 7 for jetting air in between the base plate P and the electodeposited metal plate P' and the wedges 8 to be driven in between the base plate P and the electrodeposited metal plate P', with the addition of the roller conveyers 9 which are disposed along two sides of the cathode plate P to front on the region of movement thereof for the purpose of receiving the electrodeposited metal plate P' after peeling off and the conveyers 10 disposed below said roller conveyers 9 for the purpose of transferring the base plate P.

The clamps 6 are equipped with a clamp plate 11 respectively and capable of reciprocation toward two sides of the upper part of the cathode plate P by means of the cylinder 12 connected to the rear end thereof. The air nozzle pipe 7 is installed on the side of each clamp 6 and reciprocates together with the clamp 6. The wedges 8 are respectively connected to the cylinder 13 and also pivotally fitted on the rod 15 with the aid of the spring 16, said rod 15 being provided on the arm 14 incorporated with clamp 6. This wedge 8 is not only capable of reciprocation toward two sides of the upper part of the cathode plate P by means of the clamp 6, but also capable of vertical movement along the side of the cathode plate P.

The roller conveyers 9 are, as illustrated in FIGS. 2 and 3, inclined outward respectively, and one side of each conveyeer is pivotally supported on the frame with the aid of the shaft 17 so that both conveyers can be turned by the cylinder 18 to open together downward, whereby the electrodeposited metal plate P' received thereon can be piled up on the conveyer 10 disposed thereunder.

Figure 5:
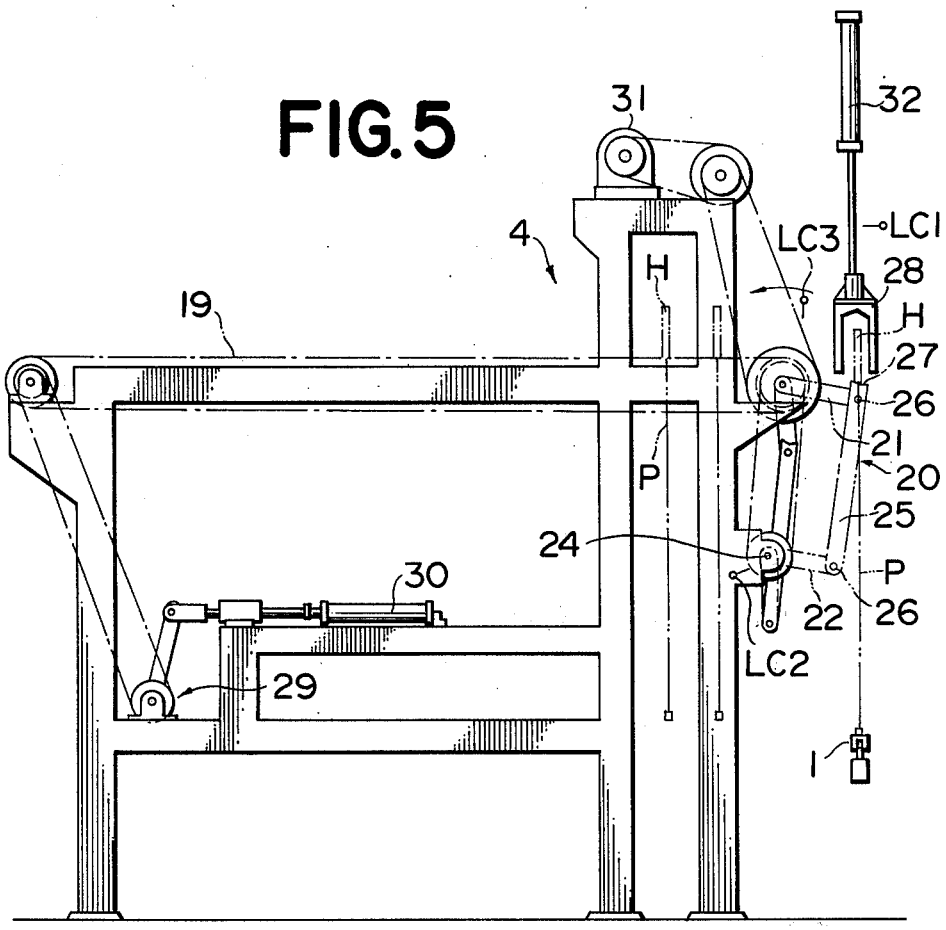
FIG. 5 is a side view of the discharging apparatus for the base plate with unpeeled metal plate.

The discharging apparatus 4 for the base plate with unpeeled metal plate is, as illustrated in FIG. 5, constructed such that, a conveyer 19 to suspend to base plate P with unpeeled metal plate with the aid of a head bar H is installed in the upper part of the frame and a shifting means 20 is installed on one end — which confronts the region of movement of said base plate P with unpeeled metal plate — of said conveyer 19. In FIG. 5, references 21, 22 denote links constituting said shifting means 20, said link 21 having its one end fixed on a shaft 23 which is pivotally supported on the same shaft as that of a chain wheel of the conveyer 19 while said link 22 having its one end fixed on a shaft 24 which is pivotally supported on the frame below it. A link 25 is pivotally connected to both other ends of these links 21, 22 by means of a shaft 26 respectively. And, on the upper end of this link 25 is provided a groove 27 for the purpose of transferring the base plate P with unpeeled metal plate put on the crossfeed conveyer 1 onto the conveyer 19 with the aid of the head bar H.

Reference 28 denotes a guide frame for the purpose of guiding the upper edge of the base plate P with unpeeled metal plate at a portion confronting the discharging apparatus 4 as a substitute for a guide plate: this guide frame is devised to be capable of ascending and descending by means of a cylinder 32. Reference 29 denotes a ratchet mechanism, and 30 denotes a cylinder which is supposed to drive the conveyer 19 intermittently at regular intervals. Reference 31 denotes a motor.

Figure 6:
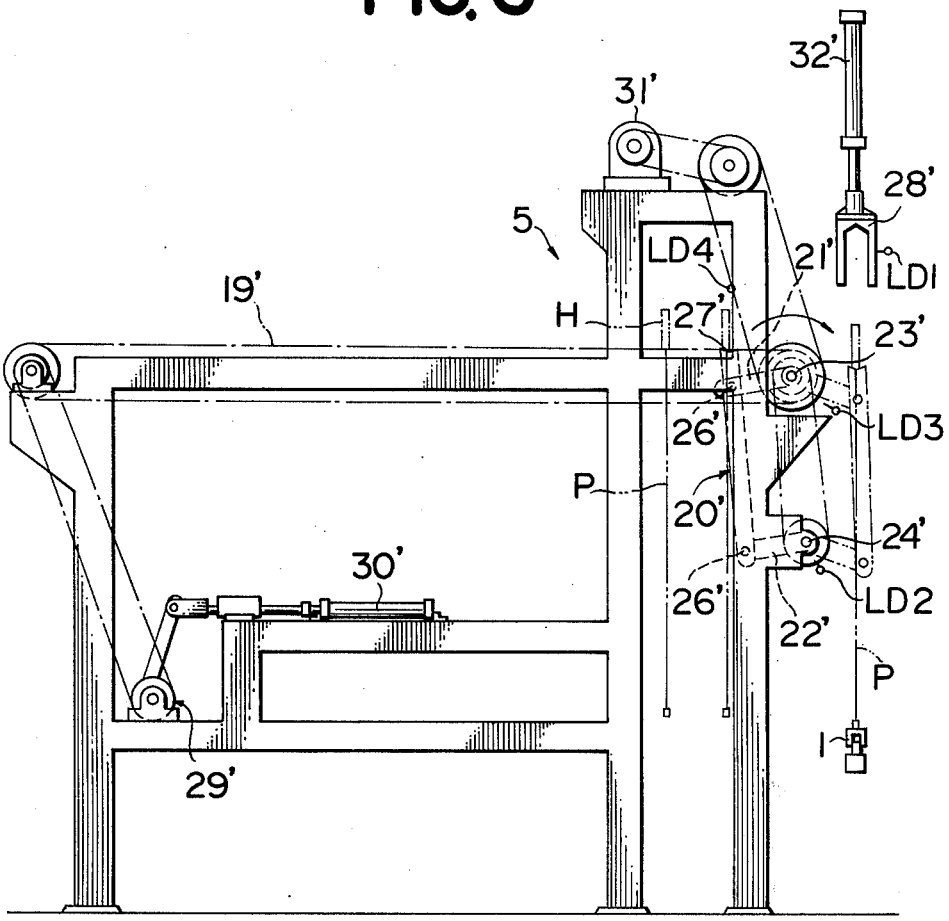
FIG. 6 is a side view of the spare base plate supplying apparatus.
Figures 7, 7A:
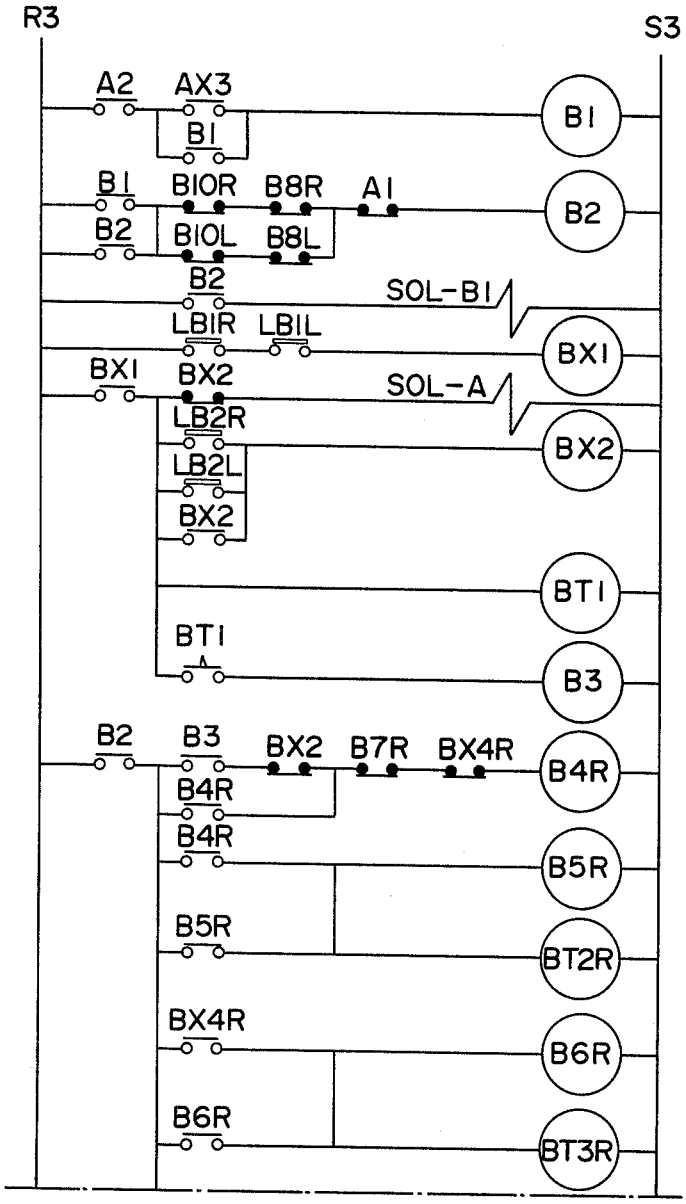
Figures 7, 7A:
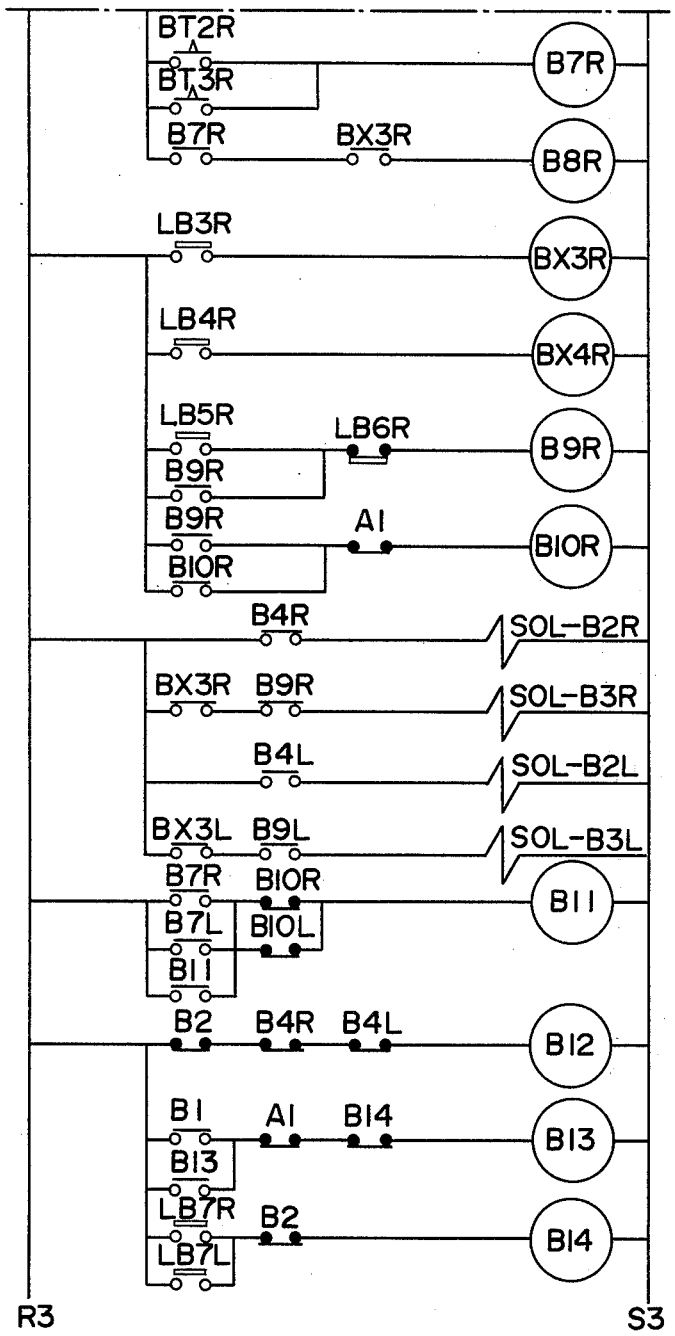
Figure 7:
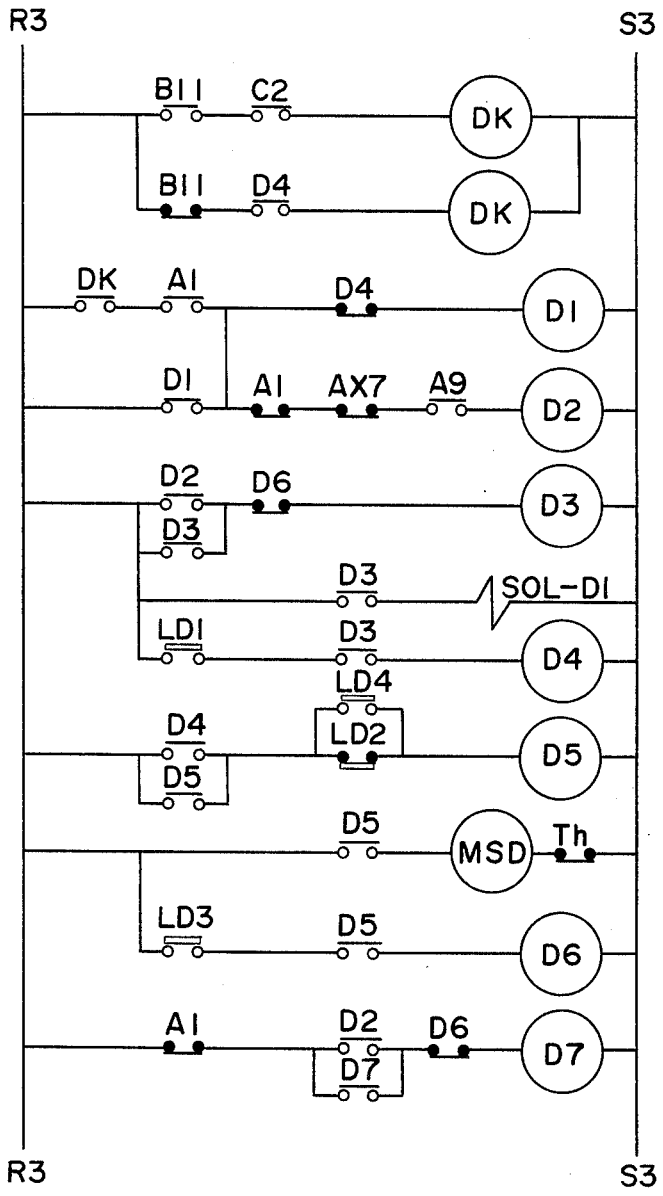

The supplying apparatus 5 FIG. 6 for supplying a spare base plate separated from electrodeposited metal plate in place of a base plate with unpeeled metal plate is substantially the same in construction as the foregoing discharging apparatus 4 for base plate with unpeeled metal plate, excepting that the shifting means 20' has its upper part inclined backward in contrast with the shifting means 20 of said discharging apparatus 4, the direction of movement of the shifting means 20' is reversed and it engages with the base plate P put on the conveyer 19' thereby to transfer it onto the crossfeed conveyer 1, and the direction of driving of the conveyer 19' is inverse. Therefore, for the sake of simplification, the members of the supplying apparatus 5 which correspond to that of the foregoing discharging apparatus 4 are represented by the same reference numeral save for attachment of the mark(′), and description thereof is dispensed with.

OPERATION

Figure 7:
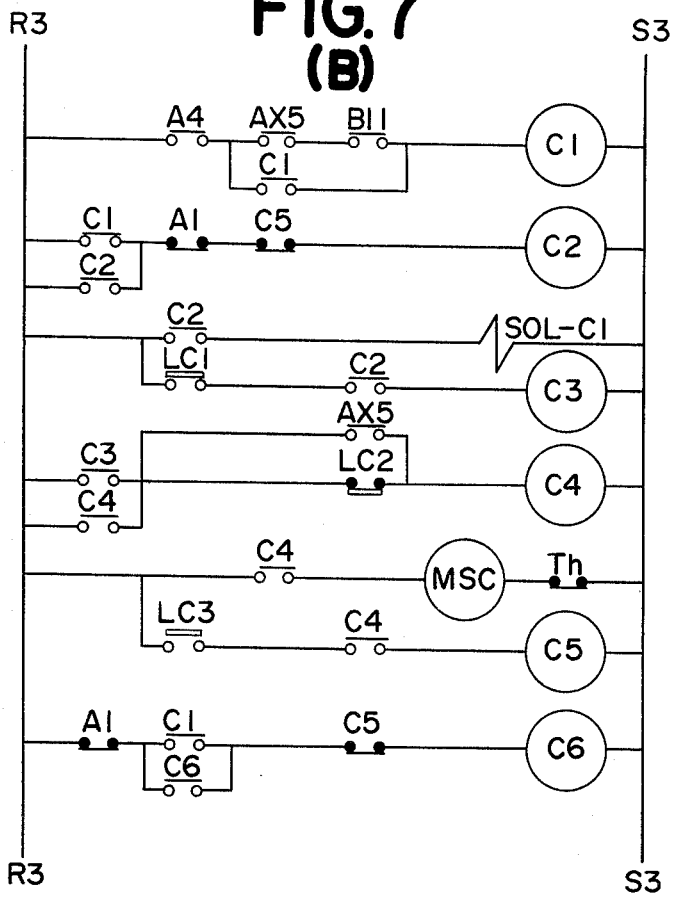
FIG. 7 is illustrative of sequences of operations, wherein (A) is the sequence of operations of the electrodeposited metal plate peeling off apparatus, (B) is the sequence of operations of the discharging apparatus, and (C) is the sequence of operations of the supplying apparatus.

Next, the mode of operation of the present embodiment will be explained by reference to the sequences in FIG. 7. In this context, in the sequence (A), inasmuch as the symmetrical wedges 8 disposed along two sides of the cathode plate P and so forth are of the same behavior, a portion of the sequence is herein omitted and accordingly explanation relevant thereto is also omitted in part.

When a cathode plate P put on the crossfeed conveyer 1 and conveyed sideways along the guide plate arrives at a position confronting the hammering apparatus 2, a sensor not shown in the drawings senses this and stops the crossfeed conveyer 1, the air hammer is actuated to apply impact intermittently upon the electrodeposited metal plates attached to both the surface and the back of the upper part of the cathode plate thereby to form a fine gap in between the cathode's base plate P and the electrodeposited metal plate P', and after a prescribed time the air hammer stops working and retreats. Then, the crossfeed conveyer 1 is driven again to shift the cathode plate P which has undergone the impact process by a distance equivalent to one pitch transversely, and when the cathode plate P arrives at a position confronting the peeling off apparatus 3, a sensor not shown in the drawings senses this thereby to stop the crossfeed conveyer 1. When the stop of the crossfeed conveyer 1 is confirmed, the contacts A2, AX3 close accordingly, the electromagnetic valve SOL-B1 is opened by means of the relay B2, the cylinder 12 is actuated to advance the clamp 6 toward the cathode plate P, the air nozzle pipes 7 and the wedges 8 also advance in concert with the clamp 6, and at the time when the clamp plates 11 of the clamps 6 have held the cathode plate P therebetween, the clamps 6 reach to the terminum of advance. At this, the limit switches LB1R, LB1L sense this, the contact BX1 closes by means of the relay BX1 and the electromagnetic valve S0L-A opens, whereby air is jetted from the nozzle pipe 7 toward the gap between the base plate P and the electrodeposited metal plate P' to widen said gap. At the point in time when the clamp 6 arrived at the terminum of advance, by the closure of the contact BX1, the timer BT1 is set, and when the contact BT1 closes after a prescribed interval of time and the contact B3 closes by means of the relay B3, inasmuch as the contact B2 is already closed, the contact B4R is closed by the relay B4R, whereby the electromagnetic valve S0l-B2R opens and the cylinder 13 is actuated to make the wedge 8 descend. And, at the same time, the contact B5R is closed by the relay B5R and also the timer BT2R is set. When the wedge 8 is sensed by the limit switches LB2R, LB2L upon descending by a prescribed distance, the electromagnetic valve S0L-A is closed by the relay BX2 to discontinue the jetting of air from the nozzle pipe 7, but the wedge 8 is let cut in between the base plate P and the electrodeposited metal plate P' to descend and peel off said metal plate P'. When the wedge 8 reaches to the terminum of descent, the limit switches LB4R, LB4L senses this. At this, the normally closed contact BX4R is opened by the relay BX4R, and the relay B4R is cut to close the electromagnetic valve S0L-B2R, whereby the cylinder 13 is actuated reversely to make the wedge 8 ascend. And, at the same time, the contact BX4R is closed, the contact B6R is closed by the relay B6R, and also the timer BT3R is set. The wedge 8 stops upon arrival at the terminum of ascent. When the limit switches LB3R, LB3L sense this, each contact BX3R is closed by the relay BX3R. Even during this operation, the timers BT2R, BT3R remember the fall of metal plate P' and the relay B2 is cut, and this state of being set is held intact until the clamp 6 retreats and the contact B2 opens.

Meanwhile, the metal plate P' peeled off the base plate P falls down on the roller conveyer 9 to slip down along the slope thereof. When the limit switches LB5R, LB5L sense this, the contact B9R is closed by the relay B9R and remembers the peeling-off. As to the roller conveyer 9, when the wedge 8 reaches the terminum of ascent and the contacts BX3R, BX3L close, by virtue of the memory of the contact B9R, the electromagnetic valves S0L-B3R, S0L-B3L open and the roller conveyer 9 turns downward centering around the respective shaft 17 by means of the cylinder 18, whereby the metal plate P' is let fall on the conveyer 10 disposed below the roller conveyer 9 to be piled up thereon. When the roller conveyer 9 reaches the terminum of descent, it is sensed by the limit switches LB6R, LB6L, the relays B9R, B9L are cut, the contacts B9R, B9L open, the electromagnetic valves S0L-B3R, S0L-B3L close and the cylinder 18 is actuated reversely, whereby the roller conveyer 9 is restored to its initial position.

When the electrodeposited metal plate P' on the roller conveyer 9 is sensed by the limit switches LB5R, LB5L and the peeling-off of said metal plate P' is confirmed, the normally closed contacts B10R, B10L open, and the relay B2 is cut to open the contact B2, whereby the setting of the timers BT2R, BT2L BT3R and BT3L is cancelled.

Further, when the electromagnetic valve S0L-B1 closes, the cylinder 12 is actuated reversely, the clamp 6, nozzle pipe 7 and wedge 8 retreat and reach the terminum of retreat, and the limit switches LB7R, LB7L sense this, the crossfeed conveyer 1 is driven to advance the base plate P deprived of the electrodeposited metal plate P' by a prescribed distance while accepting a new cathode plate P.

In the case where the cathode plate P confronting the peeling off apparatus 3 is the so-called tightly electrodeposited cathode plate and fails to have its electrodeposited metal plate P' peeled off, this is sensed in the following way:

There are two instances where the electrodeposited metal plate P' fails to be peeled off: one is the case where no gap is formed between the electrodeposited metal plate P' and the cathode's base plate P even through subjected to the impact process, or even if any gap can be formed, said gap cannot be widened by jetting air from the air nozzle pipe and accordingly the wedge 8 fails to cut in between the electrodeposited metal plate P' and the base plate P but it slides down along the outer surface of the metal plate P'; the other is the case where the wedge 8 manages to cut in between the electrodeposited metal plate P' and the base plate P, but because of the cohesion of both plates being too strong, the wedge 8 is stopped in the course of descent.

1. In the case where the wedge 8 slides down along the outer surface of the electrodeposited metal plate P':

When the wedge 8 reaches the terminum of descent, it is sensed by the limit switch LB4R as described in the foregoing, the contact BX4R closes, the contact B6R is closed by the relay B6R, and the timer BT3R is set. Upon arrival at the terminum of descent, the wedge 8 ascends directly to return to its initial position, but as the electrodeposited metal plate P' is left unpeeled, even after the lapse of a prescribed time, the limit switches LB5R, LB5L cannot sense any peeled off metal plate P', and accordingly, the timer BT3R is not released but is left working continuously and after the lapse of a prescribed time closes the contact BT3R, and the contact B7R is closed by the relay B7R. And, as the contact BX3R is being closed at the time when the wedge 8 has reached the terminum of ascent, the clamp 6 is made to retreat by the relay B8R at the same time, the occurrence of the base plate with unpeeled metal plate is remembered by the relay B11 which gives a signal to the discharging apparatus 4 for discharging the base plate with unpeeled metal plate.

2. In the case where the wedge 8 becomes incapable of peeling off in the course of descent:

After the lapse of a prescribed time subsequent to finishing the clamping motion of the clamp 6 on the cathode plate P, the contact B3 is closed by the relay B3, the wedge 8 starts descending, and at the same time, the contact B4R is closed by the relay B4R, whereby the timer BT2R is set.

However, as the wedge 8 is stopped in the course of descent, the electrodeposited metal plate P' will never be peeled off. Therefore, a prescribed time passes while the limit switch LB5R on the roller conveyer 9 is still unable to sense the metal plate P', so the contact BT2R is closed by the actuation of the timer BT2R, the failure in peeling-off is sensed by the relay B7R, the contact B7R is closed, the occurrence of a cathode plate P with unpeeled metal plate is sensed by the relay B11, a signal is given to the discharging apparatus 4 and, at the same time, the normally closed contact B7R is opened to cut the relay B4R, the contact B4R is opened to close the electromagnetic valves S0L-B2R, and the cylinder 13 is actuated reversely, whereby the wedge 8 is pulled up. When the limit switches LB3R, LB3L sense the return of the wedge 8 to the terminum of ascent, the contact BX3R is closed by the relay BX3R, the normally closed contact B8R is opened by the relay B8R, and the relay B2 is cut to make the clamp 6 retreat. When the limit switches LB7R, LB7L sense the clamp 6 at the terminum of its retreat, the crossfeed conveyer 1 is actuated to shift the base plate P with unpeeled metal plate transversely by a distance equivalent to one pitch thereby to make it confront the discharging apparatus 4.

Next, the mode of operation of the discharging apparatus 4 for the base plate with unpeeled metal plate will be explained in the following.

It is to be ascertained first that cathode plate has been conveyed along the crossfeed conveyer 1 and arrived at a position confronting the discharging apparatus 4 with the closure of the contacts A4, AX5. In the case where the cathode plate P arrived at said position is a normal base plate after having the electrodeposited metal plate P' peeled off, the contact B11 does not close and accordingly the discharging apparatus 4 is not actuated, but in the case where said plate is a base plate with unpeeled metal plate, the contact B11 is closed by the relay B11, and accordingly the contact C1 is closed by the relay C1, the contact C2 is closed by the relay C2, and the electromagnetic valve S0L-C1 opens to actuate the cylinder 32, whereby the guide frame 28 ascends. While the guide frame 28 is in the course of ascending to the terminum of ascent, the limit switch LC1 senses this, the contact C3 is closed by the relay C3, the contact C4 is closed by the relay C4, the motor MSC (or 31) is driven to rotate the shifting means 20, and the head bar H of the base plate with unpeeled metal plate is engaged with the groove 27 of said shifting means 20, whereby said base plate P with unpeeled metal plate is lifted from the crossfeed conveyer 1 and transferred onto the conveyer 19. In the course of this transfer, said base plate P with unpeeled metal plate is sensed by the relay C5, the relay C2 is cut to close the electromagnetic valve S0L-C1, the cylinder 32 is actuated reversely, the guide frame 28 is made to descend thereby to return to its initial position, the shifting means 20 is further turned thereby to suspend the base plate P with unpeeled metal plate from a chain above the conveyer 19, and when the shifting means 20 turning downward finishes one revolution, the limit switch LC2 senses this and cuts the relay C4 to stop the motor MSC(31), whereby one cycle is finished. Meanwhile, when a base plate P with unpeeled metal plate has been transferred onto the conveyer 19 and a sensor not shown in the drawings senses this, said conveyer 19 is driven to advance by the actuation of the cylinder 30 and the ratchet mechanism 29 thereby to advance said base plate P with unpeeled metal plate by a prescribed distance, and stops thereupon.

Next, the mode of operation of the supplying apparatus 5 for the purpose of filling a vacancy arising from the discharge of a base plate with unpeeled metal plate on the crossfeed conveyer 1 with a spare base plate P will be explained in the following.

In the case of a normal cathode plate P from which the electrodeposited metal plate P' has been peeled, the relay B11 for sensing the occurrence of a base plate with unpeeled metal plate and the relay C2 for guiding a base plate with unpeeled metal plate to the discharging position do not work thereon, and accordingly the contacts B11, C2 are left open, the keep relay DK is not actuated, and the spare base plate supplying apparatus is not actuated either. But, in the case of occurence of any base plate with unpeeled metal plate, the contacts B11, C2 close, the keep relay DK is set to remember it, the crossfeed conveyer 1 advances by a distance equivalent to one pitch to actuate the relay D1, the conveyer stopping relay A9 is actuated to bring the crossfeed conveyer 1 to a halt, and the relay D2 is actuated to close the contact D2. When the contact D2 closes, the contact D3 closes, the electromagnetic valve S0L-D1 opens, the guide frame 28' is elevated by the cylinder 32', said guide frame 28' is sensed by the limit switch LD1 while being thus elevated, the contact D4 is closed by the relay D4, and next the arrival of the base plate P to be supplied onto the conveyer 19' is sensed by the limit switch LD. Also, the contact D5 is closed by the relay D5, the motor MSD (31') is driven to actuate the shifting means 20', the head bar H of the base plate P on the conveyer 19' is engaged with the groove 27' whereby said base plate P is hung up, and said shifting means 20' thus hanging the base plate P rotates and deposits it on the crossfeed conveyer 1. At this point in time, the limit switch LD3 senses the base plate P, the normally closed contact D6 is opened by the relay D6, the relay D3 is cut to open the contact D3, the electromagnetic valve S0L-D1 is closed, the guide frame 28' is made to descend by the cylinder 32' and its guide groove is fitted on the upper part of the base plate P thereby to hold it. The shifting means 20' is further rotated, and at the point in time when the shifting means 20' finishes one revolution, the limit switch LD2 senses this, the relay D5 is cut, the contact D5 opens, the motor (31) is stopped, and the rotation of the shifting means 20' is discontinued, whereby one cycle is finished. Meanwhile, when one base plate P has been taken away from the conveyer 19' and the limit switch LD4 senses this, the cylinder 30' and the ratchet mechanism 29' are actuated to drive the conveyer 19' to progress by a prescribed distance, the remaining spare base plates P are advanced accordingly to be ready for the next supply of a base plate P.

What is claimed is:

1. In an apparatus for peeling off electrodeposited metal plates from cathode base plates, said apparatus including transfer means for intermittently moving a cathode plate composed of a base plate having an electrodeposited metal plate thereon along a processing line having a series of spaced work stations, means disposed at a first work station for loosening the electrodeposited metal plate from the base plate, stripping means for peeling the electrodeposited metal plate from the base plate, said stripping means being disposed at a second work station disposed downstream of said first work station, and receiving means associated with said stripping means for receiving thereon the metal plate which is peeled from the base plate when said cathode plate is disposed in said second working station, the improvement comprising:

sensing means associated with said receiving means for sensing the presence thereon of the peeled metal plate which has been stripped from a base plate;

discharge means for automatically removing a base plate from said transfer means, said discharge means being disposed at a third work station which is disposed downstream of said second work station; and control means for selectively actuating said discharge means only to remove from said transfer means those base plates from which the stripping means has been unable to successfully peel off the metal plates, said control means including activating means for actuating said discharge means only after elapse of a preselected time interval following initiation of a stripping operation and only if said sensing means does not sense the presence of the peeled metal plate on said receiving means during said preselected time interval.

2. An apparatus according to claim 1, wherein said stripping means includes a stripping member which is linearly movable through a preselected stripping stroke in a first direction across a face of the base plate to effect peeling of the metal plate therefrom, and said control means including timing means activated in response to said stripping stroke for determining said preselected time interval.

3. An apparatus according to claim 2, wherein said timing means includes a first timer which is initiated at the beginning of said stripping stroke for timing a first preselected time interval, said timing means also including a second timer initiated when said stripping member reaches the end of the stripping stroke for timing a second preselected time interval, and said activating means being activated only following the elapse of either said first or second preselected time intervals without said sensing means having sensed the presence of the peeled metal plate on said receiving means.

4. An apparatus according to claim 1, including supply means for automatically supplying an empty base plate to said transfer means whenever a base plate is removed therefrom by said discharge means, whereby the empty base plate fills the vacancy on the transfer means created by the removal of a base plate by said discharge means.

5. An apparatus according to claim 4, wherein said supply means is disposed at a fourth working station located downstream of said third working station, and said control means including activating means for said supply means which is activated only following a preceding activation of said discharge means.

6. An apparatus according to claim 4, wherein said stripping means includes a stripping member which is linearly movable through a preselected stripping stroke in a first direction across a face of the base plate to effect peeling of the metal plate therefrom, and said control means including timing means activated in response to said stripping stroke for determining said preselected time interval.

7. An apparatus according to claim 1, wherein said sensing means includes limit switch means disposed for contact with the peeled metal plate which is deposited on said receiving means.

* * * * *